US005860683A

United States Patent [19]

Sekino et al.

[11] Patent Number: 5,860,683

[45] Date of Patent: Jan. 19, 1999

[54] AUTOMOTIVE DOOR LOCK DEVICE

[75] Inventors: Masami Sekino; Shingo Gotoh, both of Atsugi, Japan

[73] Assignees: Ohi Seisakusho Co., Ltd.; Nissan Motor Co., Ltd., both of Yokohama, Japan

[21] Appl. No.: 659,719

[22] Filed: Jun. 6, 1996

[30] Foreign Application Priority Data

Jun. 9, 1995 [JP] Japan ..... 7-143010

[51] Int. Cl.[6] ..... E05C 3/06

[52] U.S. Cl. ..... 292/216; 292/DIG. 41; 292/DIG. 65

[58] Field of Search ..... 292/216, 337, 292/DIG. 23, DIG. 41

[56] References Cited

U.S. PATENT DOCUMENTS

| | | | |
|---|---|---|---|
| 3,331,624 | 7/1967 | Pugh | 292/216 |
| 3,709,537 | 1/1973 | Kazaoka et al. | 292/216 |
| 3,767,243 | 10/1973 | Yoshimura | 292/216 |
| 4,097,078 | 6/1978 | Tack et al. | 292/216 |
| 4,235,462 | 11/1980 | Torri et al. | 292/216 |
| 4,775,176 | 10/1988 | Ikeda | 292/216 |
| 4,896,907 | 1/1990 | Hayakawa | 292/216 |
| 4,898,414 | 2/1990 | Yamada | 292/337 |
| 5,288,115 | 2/1994 | Inoue et al. | 292/201 |

FOREIGN PATENT DOCUMENTS

| | | |
|---|---|---|
| 1101414 | 1/1968 | United Kingdom . |
| 1114924 | 5/1968 | United Kingdom . |
| 2 197 682 | 5/1988 | United Kingdom . |

*Primary Examiner*—Steven Meyers
*Assistant Examiner*—Gary Estremsky
*Attorney, Agent, or Firm*—Foley & Lardner

[57] ABSTRACT

A door lock device for use with a striker, comprises a cover plate having an elongate cut into which the striker is insertable. A latch plate is pivotally connected to the cover plate, which is capable of taking a latching position wherein the latch plate is engaged with the striker. A locking plate is pivotally connected to the cover plate, which is capable of taking a locking position wherein the locking plate is engaged with the latch plate to restrain the same at the latching position. A reinforcing shaft is secured to the cover plate and has an enlarged flange formed on a leading end thereof. The above-mentioned parts are so arranged that at least a part of the locking plate is placed between the cover plate and the enlarged flange when the locking plate is in the locking position.

8 Claims, 4 Drawing Sheets

AUTOMOTIVE DOOR LOCK DEVICE

BACKGROUND OF THE INVENTION

1. Description of the Prior Art

The present invention relates in general to door lock devices, and more particularly to automotive door lock devices of a type which exhibits a high durability against a marked shock produced when an associated motor vehicle is encounters a vehicle collision or the like.

2. Description of the Prior Art

In conventional automotive door lock devices, there is a type which comprises a metal cover plate which has a striker receiving recess into which a striker (more specifically, a striker proper part of the striker) is insertable, a latch plate which is pivotally connected to the cover plate and detachably engageable at its leg portion with the striker, and a locking plate which is pivotally connected to the cover plate and engageable at its pawl portion with the latch plate to suppress return pivoting of the latch plate.

Usually, the door lock device is mounted to a door of a vehicle and the striker is fixed to a body of the vehicle. Upon closing of the door, the leg portion of the latch plate is brought into engagement with the striker and the pawl portion of the locking plate is brought into abutment with the latch plate to suppress a return pivoting of the latch.

When the vehicle encounters a vehicle collision or the like, a certain impact force is suddenly applied to the door lock device in not only a direction in which the door becomes opened (that is, a direction in which the striker proper of the striker escapes from the striker receiving recess) but also a fore-and-aft direction of the vehicle (that is, a direction of the axis of the striker proper of the striker).

Thus, when the impact force applied is too great, it tends to occur that not only the latch plate but also the cover plate and locking plate are largely deformed.

In order to solve this drawback, some of the conventional door lock devices employ thicker materials for such parts.

However, as is easily understood, usage of such thicker materials for the parts causes a bulky, heavy and costly construction of door lock device.

SUMMARY OF THE INVENTION

It is therefore an object of the present invention to provide an automotive door lock device which is free of the above-mentioned drawbacks.

According to a first aspect of the present invention, there is provided a door lock device for use with a striker, which comprises a cover plate having an elongate cut into which the striker is insertable; a latch plate pivotally connected to the cover plate, the latch plate being capable of taking a latching position wherein the latch plate is engaged with the striker which has been in the elongate cut; a locking plate pivotally connected to the cover plate, the locking plate being capable of taking a locking position wherein the locking plate is engaged with the latch plate to restrain the same at the latching position; and a reinforcing shaft secured to the cover plate and having an enlarged flange formed on a leading end thereof, wherein at least a part of the locking plate is placed between the cover plate and the enlarged flange when the locking plate is in the locking position.

According to a second aspect of the present invention, there is provided a door lock device for use with a striker, which comprises a recessed body having a striker receiving groove into which the striker is insertable; a cover plate having an elongate cut, the cover plate being attached to one side surface of the body having the elongate cut merged with the striker receiving groove; a latch plate pivotally installed between the body and the cover plate, the latch plate being capable of taking a latching position wherein the latch plate is engaged with the striker which has been in the striker receiving groove; a locking plate pivotally installed between the body and the cover plate, the locking plate being capable of taking a locking position wherein the locking plate is engaged with the latch plate to restrain the same at the latching position; and a reinforcing shaft secured to the cover plate and piercing the body, the reinforcing shaft having an enlarged flange formed on a leading end thereof, wherein at least a part of the body and at least a part of the locking plate are placed between the cover plate and the enlarged flange when the locking plate is in the locking position.

BRIEF DESCRIPTION OF THE INVENTION

Other objects and advantages of the present invention will become apparent from the following description when taken in conjunction with the accompanying drawbacks, in which.

DETAILED DESCRIPTION OF THE EMBODIMENTS

Referring to FIGS. 1 to 5, there is shown an automotive door lock device 1 which is a first embodiment of the present invention.

Figure 2:
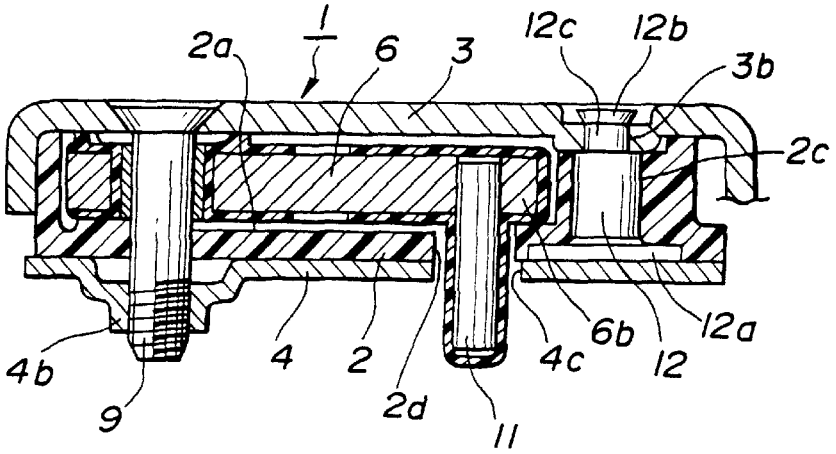
FIG. 2 is a sectional view taken along the line II—II of FIG. 1.
Figure 3:
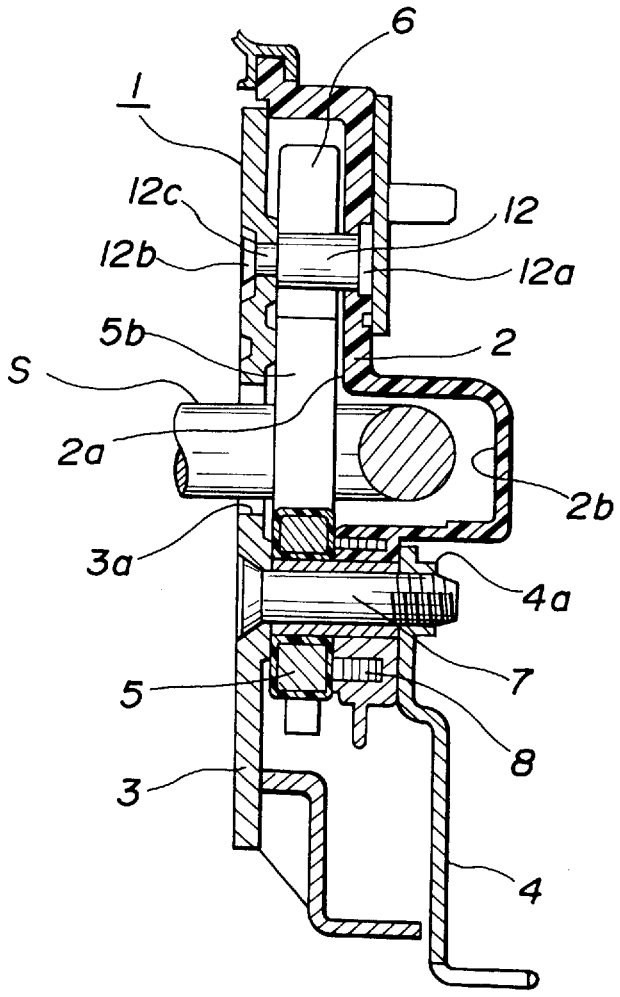
FIG. 3 is a sectional view taken along the line III—III of FIG. 1.

As is understood from FIGS. 2 and 3, the door lock device 1 comprises a plastic body 2 which has a recess 2*a* formed therein. A metal cover plate 3 is attached to one side surface of the plastic body 2 to cover the recess 2*a*, and a metal base plate 4 is attached to the other side surface of the plastic body 2.

The door lock device 1 is secured to an automotive door (not shown) by means of connecting bolts (not shown) which pass through three bolt openings 1*a* (see FIG. 1) formed through the lock device 1.

Figure 4:
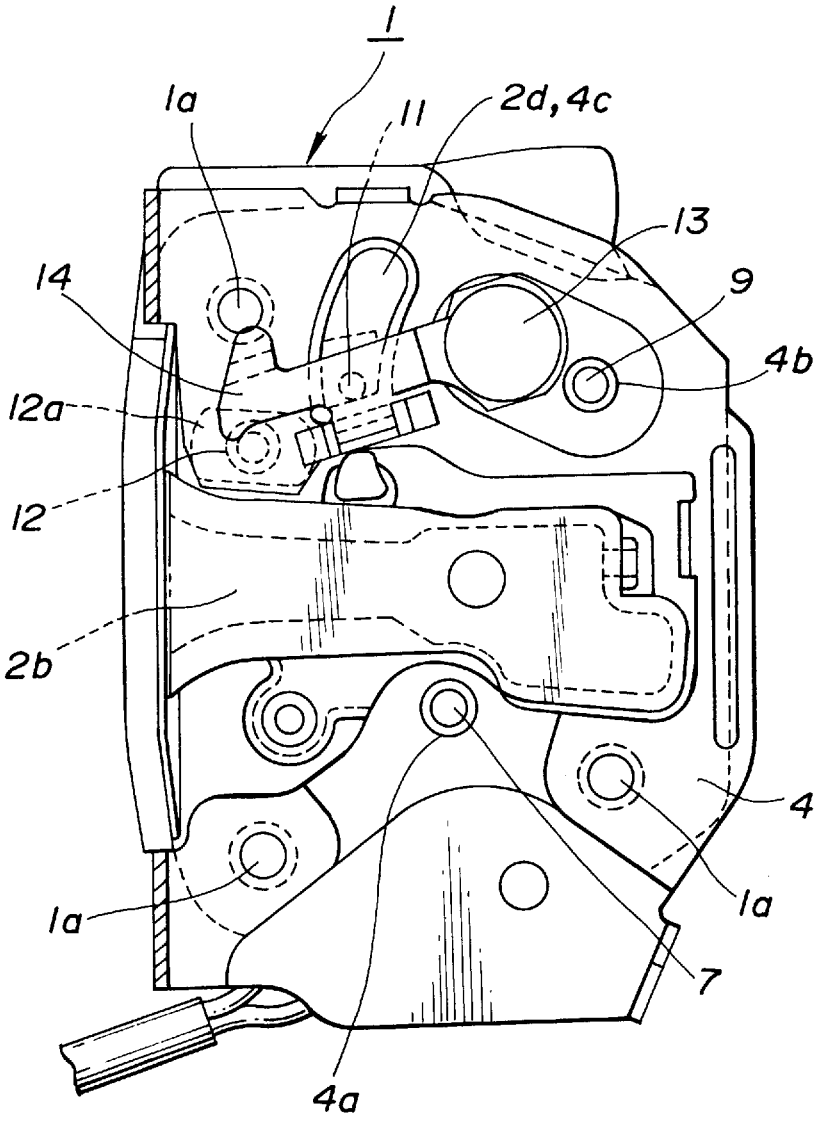
FIG. 4 is a back view of the door lock device of the first embodiment.

As is seen from FIGS. 3 and 4, the plastic body 2 is formed with a striker receiving groove 2*b* at a vertically middle part of the bottom of the recess 2*a*. As will become apparent as the description proceeds, upon closing of the door, the striker receiving groove 2*b* receives therein a striker "S" (more specifically, a striker proper of the striker, see FIG. 1) which is secured to a vehicle body (not shown).

Figure 1:
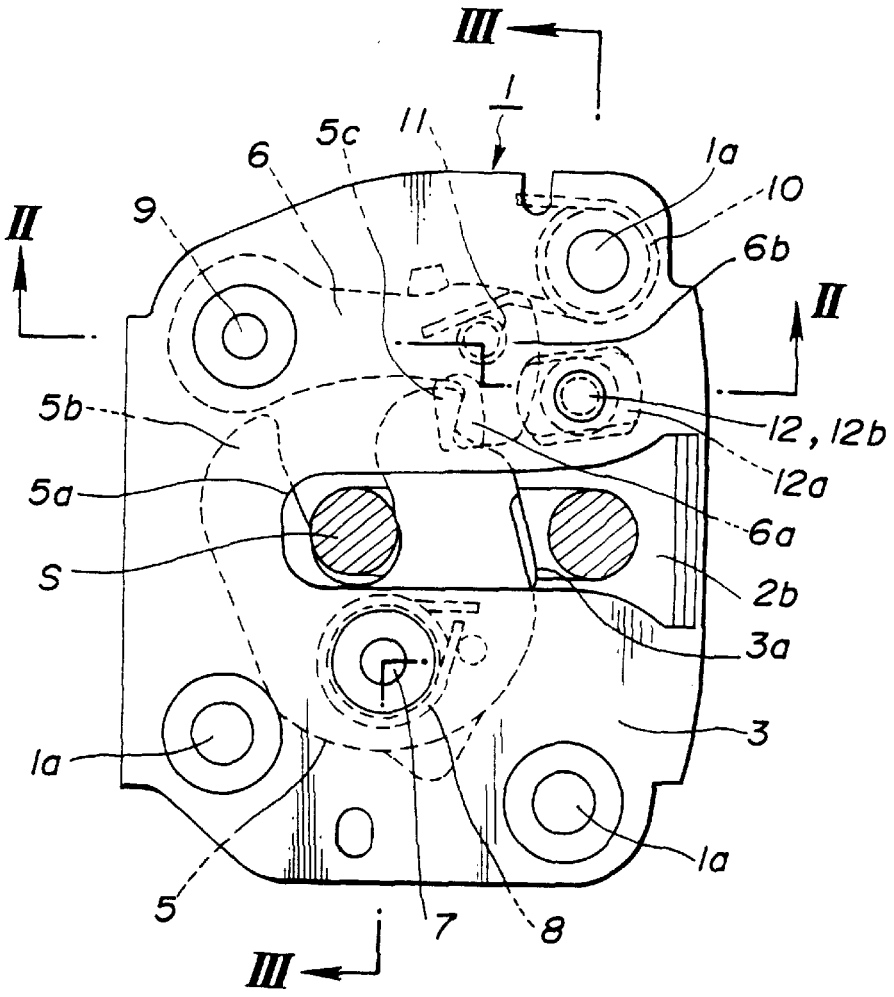
FIG. 1 is a front view of a door lock device which is a first embodiment of the present invention.

As is understood from FIG. 1, the metal cover plate 3 is formed with an elongate cut 3*a* which is merged with the striker receiving groove 2*b* of the plastic body 2.

Within the recess 2*a* of the plastic body 2, there are pivotally installed a latch plate 5 and a locking plate 6.

As is seen from FIGS. 1 and 3, the latch plate 5 is pivotally disposed on a bolt 7 which extends between the cover plate 3 and the base plate 4. As is shown in FIG. 3, the bolt 7 is screwed into a threaded hole 4*a* which is formed in the base plate 4 below the striker receiving groove 2*b*.

With this arrangement, the latch plate 5 is pivotal between a latching position wherein, as shown in FIG. 1, the latch plate 5 fully engages with the striker "S" and an unlatching position wherein the latch plate 5 releases the striker "S", the unlatching position being taken when the latch plate 5 is pivoted clockwise in FIG. 1 from the latching position. That is, when the door is closed, the latch plate 5 is forced to take the latching position, and, when the latch plate 5 is forced to take the unlatching position, the door is permitted to open.

The latch plate 5 is formed with first and second leg portions 5*b* and 5*c* which define therebetween an engaging recess 5*a*. A spring 8 is disposed about the bolt 7 to bias the latch plate 5 toward the unlatching position.

As is understood from FIGS. 1, 2 and 3, the locking plate 6 is pivotally disposed on a bolt 9 which extends between the cover plate 3 and the base plate 4 through the plastic body 2. As is shown in FIGS. 1 and 2, the bolt 9 is screwed into a threaded hole 4*b* which is formed in a raised part of the base plate 4 above the striker receiving groove 2*b* near the bottom of the elongate cut 3*a* of the cover plate 3. The locking plate 6 is formed with a pawl portion 6*a* which is engageable with the first and second leg portions 5*b* and 5*c* of the latch plate 5. Due to work of a spring 10 installed in the plastic body 2, the locking plate 6 is biased clockwise in FIG. 1, that is, in a direction to engage the pawl portion 6*a* thereof with the first or second leg portion 5*b* or 5*c* of the latch plate 5.

The locking plate 6 is pivotal between a locking position wherein, as is shown in FIG. 1, the pawl portion 6*a* of the locking plate 6 is engaged with the second leg portion 5*c* of the latch plate 5 and an unlocking position wherein the pawl portion 6*a* releases the second leg portion 5*c*, the unlocking position being taken when the locking plate 6 is pivoted counterclockwise in FIG. 1 from the locking position against the biasing force of the spring 10. When, with the door kept open, the latch plate 5 is in the releasing position, the pawl portion 6*a* of the locking plate 6 is pressed against a back part of the first leg portion 5*b* of the latch plate 5 due to the force of the spring 10. Thus, when, upon closing of the door, the latch plate 5 is forced to pivot to take the latching position as shown in FIG. 1, the pawl portion 6*a* of the locking plate 6 is brought into engagement with a front part of the second leg portion 5*c* jumping over the engaging recess 5*a* of the latch plate 5. The latch plate 5 is thus locked in the full-latching position, and thus the latch plate 5 is suppressed from being pivoted toward the releasing position. Under this condition, the door is latched in the full-closed position. It is to be noted that if the closing action of the door is slowly made, the pawl portion 6*a* of the locking plate 6 may drop into the engaging recess 5*a* of the latch plate 5. In this case, the pawl 6*a* becomes in engagement with a front part of the first leg portion 5*b* of the latch plate 5 and thus a so-called half-latch condition is assumed by the door lock device 1.

As is seen from FIGS. 1, 2 and 4, the locking plate 6 is provided near the pawl 6*a* thereof with a pin 11 which is projected to the outside of the base plate 4 (see FIG. 2) through curved elongate slots 2*d* and 4*c* respectively formed in the body 2 and the base plate 4. The curved elongate slots 2*d* and 4*c* are concentric with the axis of the bolt 9. As is shown in FIG. 4, the projected end of the pin 11 is engaged with an open lever 14 which is pivotally connected to the base plate 4 through a pivot pin 13. Thus, when the open lever 14 is pivoted clockwise in FIG. 4, the locking plate 6 is forced to take the releasing position against the biasing force of the spring 10.

In the present invention, the following measure is employed for providing the door lock device 1 with a robust structure.

That is, a reinforcing shaft 12 of metal is employed. As is seen from FIGS. 1 and 2, the reinforcing shaft 12 extends between the cover plate 3 and the plastic body 2 at an upper and front portion of the door lock device 1 which is near the pawl portion 6*a* of the locking plate 6. The reinforcing shaft 12 has at one end an enlarged oval flange 12*a*. For receiving the shaft 12, the cover plate 3 and the plastic body 2 are formed with aligned bores 3*b* and 2*c*.

As is understood from FIGS. 2 and 4, one end of the bore 2*c* of the plastic body 2 is enlarged and shaped generally oval, into which the oval flange 12*a* of the reinforcing shaft 12 is intimately and tightly received. As is seen from FIG. 1, the oval flange 12*a* of the shaft 12 is so oriented that a major axis thereof extends substantially in parallel with the longitudinal axis of the striker receiving groove 2*b*, and as is seen from FIG. 2, the oval flange 12*a* is in abutment with an inner surface of the base plate 4.

As is shown in FIG. 2, the other end 12*b* of the reinforcing shaft 12 is caulked to be secured to the cover plate 3. As is seen from FIG. 1, when the locking plate 6 assumes the latching position as shown in FIG. 1 or a position to cause the lock device 1 to assume the above-mentioned half-latch condition, the oval flange 12*a* of the reinforcing shaft 12 overlaps with a leading end portion 6*b* of the locking plate 6 as viewed in a direction of the axis of the shaft 12. That is, under this condition, a part of the plastic body 2 and a part of the locking plate 6 are sandwiched between the oval flange 12*a* of the reinforcing shaft 12 and the cover plate 3.

As is seen from FIGS. 2 and 3, the reinforcing shaft 12 has near the caulked end thereof a diametrically reduced part 12*c* which is received in the bore 3*b* of the cover plate 3. That is, with provision of such diametrically reduced part 12*c*, a shoulder part is defined by the shaft 12 against which the cover plate 3 abuts. With this, the shaft 12 can serve as a spacer between the base plate 4 and the cover plate 3.

Thus, the door lock device 1 can exhibit a marked durability against a stress applied in a direction to press the cover plate 3 and the base plate 4 toward each other.

It is further to be noted that, due to provision of the reinforcing shaft 12 having the above-mentioned construction and arrangement, the durability of the door lock device 1 against a stress applied in a direction to separate the cover plate 3 and the base plate 4 from each other is remarkably increased.

In the following, advantageous operation of the door lock device 1 expected when a vehicle has the lock device 1 mounted thereon is subjected to a vehicle collision will be described with reference to FIGS. 1 and 5.

Under cruising of the vehicle, the door is kept closed having the door lock device 1 assume the full-latching condition as shown in FIG. 1.

Figure 5:
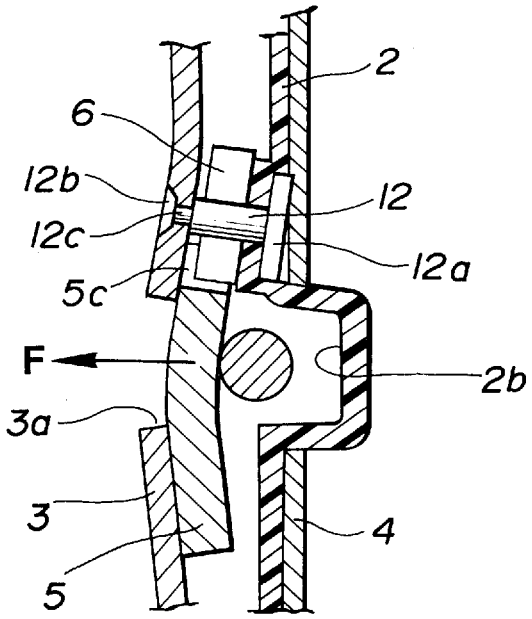
FIG. 5 is a sectional view of an essential part of the door lock device in a condition wherein the part is deformed.

When the vehicle is subjected to a head-on vehicle collision, a great impact force is suddenly applied to the striker "S" in a direction of the arrow "F" in FIG. 5, that is, in a fore-and-aft direction of the vehicle. With this impact force, the second leg portion 5*c* of the latch plate 5 is brought into abutment with the cover plate 3 inducing a deformation of the cover plate 3. However, due to the robust structure of the door lock device 1 provided by the reinforcing shaft 12, the deformation of the cover plate 3 can be minimized and thus that of the latch plate 5 can be minimized. That is, as is seen from FIGS. 5 and 2, the deformation of the cover plate 3 is effectively blocked by a robustly united structure which substantially consists of the plastic body 2, the reinforcing shaft 12, the locking plate 6 and the cover plate 3.

Thus, even if the impact force is so great as to severely deform the united structure, relative displacement between the latch plate 5 and the locking plate 6 in the direction of the thickness of the latch plate 5 is suppressed or at least minimized thereby keeping the engagement between the second leg portion 5*c* of the latch plate 5 and the pawl 6*a* of the locking plate 6. That is, upon such severe collision, the full-latching condition of the door lock device 1 is assuredly kept.

Figure 6:
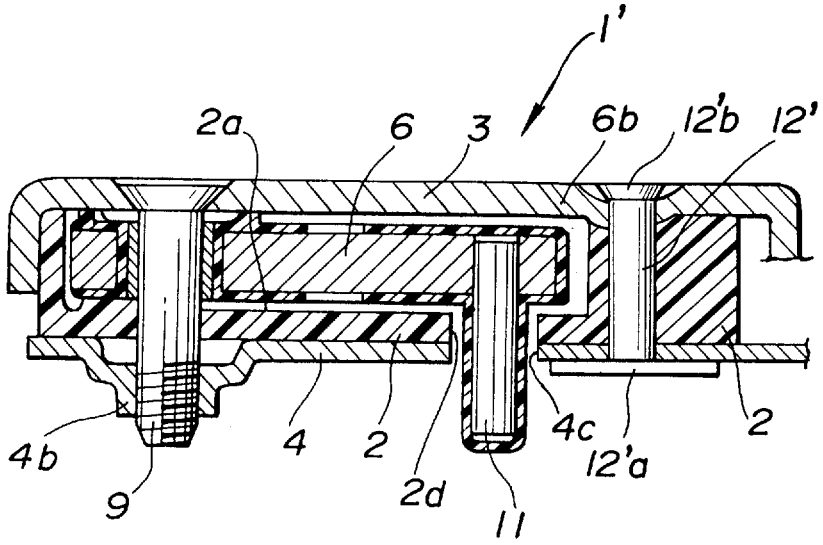
FIG. 6 is a sectional view similar to FIG. 2, but showing a second embodiment of the present invention.

Referring to FIG. 6, there is shown in a sectional manner an automotive door lock device 1' which is a second embodiment of the present invention.

Since the structure of this second embodiment 1' is similar to that of the above-mentioned first embodiment 1, only different portions will be described in detail in the following.

As shown in the drawing, in the second embodiment 1', the reinforcing shaft 12' extends between the cover plate 3 and the base plate 4. An enlarged oval flange 12'*a* formed on one end of the reinforcing shaft 12' abuts on an outer surface of the base plate, and the other end 12'*b* of the shaft 12' is caulked to be secured to the cover plate 3. That is, in this embodiment 1', between the oval flange 12'*a* and the cover plate 3, there are sandwiched the base plate 4, a part of the plastic body 2 and a part of the locking plate 6. Like in the case of the first embodiment 1, the oval flange 12'*a* is so oriented that a major axis thereof extends generally in parallel with the longitudinal axis of the striker receiving groove 2*b*. Accordingly, the above-mentioned advantageous operation of the first embodiment 1 is also expected from this second embodiment 1'.

What is claimed is:

1. A door lock device for use with a striker, comprising:

a recessed plastic body having a striker receiving groove into which said striker is insertable;

a cover plate having an elongate cut, said cover plate being attached to a side surface of said plastic body having said elongate cut, the elongate cut being merged with said striker receiving groove;

a latch plate pivotally installed between said plastic body and said cover plate, said latch plate taking a latching position when the latch plate is engaged with the striker and the striker is inserted in said striker receiving groove;

a locking plate pivotally installed between said plastic body and said cover plate, said locking plate taking a locking position when a pawl portion of the locking plate is engaged with said latch plate to restrain the latch plate at said latching position; and a metal reinforcing shaft secured to said cover plate and penetrating through said body, said reinforcing shaft having an enlarged flange formed on a leading end thereof, wherein, when said locking plate is in said locking position, at least a part of said pawl portion of said locking plate is positioned between said cover plate and said enlarged flange to cause said enlarged flange and the said pawl portion to overlap each other.

2. A door lock device as claimed in claim 1, in which said reinforcing shaft is arranged at an opposite position of a pivoted portion of said latch plate with respect to said striker receiving groove.

3. A door lock device as claimed in claim 2, in which said reinforcing shaft is arranged in the vicinity of a place where a pawl portion of said locking plate is engaged with said latch plate.

4. A door lock device as claimed in claim 1, further comprising a base plate which is secured to the other side surface of said body.

5. A door lock device as claimed in claim 4, in which said reinforcing shaft pierces said base plate, and in which a part of said base plate, the part of said body and the part of said locking plate are placed between said cover plate and said enlarged flange when said locking plate is in said locking position.

6. A door lock device as claimed in claim 1, in which the enlarged flange of said reinforcing shaft is oval in shape, and in which the oval enlarged flange is so oriented that a major axis thereof extends substantially in parallel with a longitudinal axis of said striker receiving groove of said body.

7. A door lock device as claimed in claim 2, in which a pivoted portion of said locking plate is arranged in the vicinity of the deepest part of said striker receiving groove and in which said reinforcing shaft is arranged in the vicinity of a mouth portion of said striker receiving groove.

8. A door lock device as claimed in claim 6, in which said reinforcing shaft is arranged near a mouth portion of said striker receiving groove at an opposite position of a pivoted portion of said latch plate with respect to said striker receiving groove, and in which a pivoted portion of said locking plate is arranged in the vicinity of the deepest part of said striker receiving groove.

* * * * *